United States Patent [19]

Liles

[11] Patent Number: 4,925,032

[45] Date of Patent: May 15, 1990

[54] DEVICE FOR HOLDING TACOS AND OTHER FOODS

[75] Inventor: Donald T. Liles, Midland, Mich.

[73] Assignee: D and D Enterprises, Midland, Mich.

[21] Appl. No.: 888,509

[22] Filed: Jul. 23, 1986

[51] Int. Cl.[5] ..... B65D 1/34

[52] U.S. Cl. ..... 206/564; 206/565; 426/115; 229/902

[58] Field of Search ..... 206/564, 565, 527; 426/115; 229/902

[56] References Cited

U.S. PATENT DOCUMENTS

D. 217,593 5/1970 Loven .
D. 236,786 4/1982 Kohane .
D. 238,543 1/1976 Lechner .
D. 263,191 3/1982 Moore .
D. 267,918 2/1983 Lasher .
D. 273,746 5/1984 Hunt .
D. 273,929 5/1984 Rolli .
D. 275,256 8/1984 Gilliam .
D. 278,199 7/1984 Richards .
D. 279,851 7/1985 Willis .
4,270,660 6/1981 Putt .
4,362,247 12/1982 Rueda .
4,501,367 2/1985 Potts .
4,535,891 8/1985 Murdick et al. .

*Primary Examiner*—Joseph Man-Fu Moy
*Attorney, Agent, or Firm*—Dennis H. Rainear

[57] ABSTRACT

The invention relates to holders for comestible products and, more particularly, to holders for supporting tacos in a vertical orientation. The articles of the invention include unitary holders comprising a generally U-shaped single piece body having a pair of vertical parallel walls projecting upwardly from and perpendicular to a horizontal base which extends outward from the junctures of the walls and the base. A three sided receiving trough is thereby created into which can be placed and held upright comestible products. The extended base provides sufficient stability to allow the device to be significantly smaller than the comestible products supported.

3 Claims, 2 Drawing Sheets

DEVICE FOR HOLDING TACOS AND OTHER FOODS

BACKGROUND INFORMATION

The invention relates to holders for comestible products and, more particularly, to holders for supporting tacos in a vertical orientation. A recent development in both the fast food take-out market and the home-prepared foods market is the increased demand for unusual cuisines, including, for example, Mexican and Mediterranean foods. Many times these foods are prepared by filling a pastry shell, tortilla-like shell, pocket bread, Gyros bread, hot dog bun, or taco shell with a combination of condiments and fillings such as cooked ground beef, chopped pork or lamb, shredded cheese, shredded lettuce, chopped tomato, mayonnaise, onions, and many others. During the preparation of these foods, the edible wrapper such as the taco shell must be maintained in a position such that the opening being filled with the condiments is accessible and the condiment fillings do not fall out of the shell or other edible wrapper. Because the shells, wrappers, and buns are edible, these comestible products usually are eaten by hand rather than by the use of utensils. In the usual case, this means that the preparation and consumption of the comestible products requires they be handled a certain number of times before they are completely consumed. Eating these foods oftentimes presents problems since the aforementioned fillings are usually loose, juicy and tend to fall out of their shells with repeated handling.

The patent literature does show some support devices for food products, e.g., U.S. Pat. No. 4,501,367, issued Feb. 26, 1985 to Potts claims a stand and cylindrical bowl which support a folded food shell in an upright position. This is a complicated and expensive solution to the problem.

Several U.S. Patents claim devices for supporting taco shells but these devices, however, lack adequate side support to render singular units sufficiently stable. Examples of such unstable devices include those devices claimed in U.S. Pat. Nos. D236,786, issued Apr. 13, 1982 to Vivian Kohane; D278,199, issued to Norman Richards; D273,746, issued May 8, 1984 to Dale Hunt; and U.S. Pat. No. 4,535,891 issued Aug. 20, 1985 to Brian Murdick and William Haase.

Several other United States patents present complicated and/or expensive designs for food holders including U.S. Pat. No. 4,362,247, issued Dec. 7, 1982 to Robert Rueda; U.S. Pat. No. 4,270,660, issued June 2, 1981 to Arthur Putt; U.S. Pat. No. D279,851, issued July 30, 1985 to Michael Willis; U.S. Pat. No. D263,191, issued Mar. 2, 1982 to Joseph Moore; U.S. Pat. No. 4,501,367, issued Feb. 26, 1985 to C. Potts; and U.S. Pat. No. D217,593, issued May 19, 1970 to James Loven.

Several patents claim taco holders or supports for other foods or materials wherein the design consists of four vertical posts positioned at the corners of a square. See for example, U.S. Pat. No. D267,918, issued Feb. 15, 1983 to Lasher; U.S. Pat. No D238,543, issued Jan. 27, 1976 to George Lechner; U.S. Pat. No. D273,929, issued May 22, 1984 to Ernest Rolli, Jr.

Several patents also address holders for tacos and other foods wherein a plurality of such foods are to be prepared and maintained simultaneously as, for example, in a restaurant or a home kitchen. Such a design is claimed in U.S. Pat. No. D275,256, issued Aug. 28, 1984 to Deana Gilliam.

It is thus known to orient a plurality of taco shells or a unitary taco shell, or similar comestibles topped with condiments, vertically upwardly for filling and various devices could be used for that purpose, if desired. Unfortunately, no completely acceptable holder is available for supporting tacos or similar comestibles topped condiments, in a vertically upward orientation for consumption. Although several devices exist which theoretically could hold a taco or similar comestible, all of these devices suffer drawbacks such as excessive manufacturing costs due to complicated designs and excess materials, difficulty in cleaning, lack of stability sufficient to support a taco shell which has become top-heavy with a high center of gravity due to being filled with various foods, or lack of attractiveness to the consumer. Attractiveness to the consumer includes such features as simplicity, size, ease of storage, and constructed of materials safe for use in microwave ovens, and which can withstand automatic dishwashers. Another attraction to the consumer would be a holder for tacos and other comestibles which is constructed of inexpensive, and therefore disposable, materials.

SUMMARY OF THE INVENTION

The instant invention overcomes the foregoing and other problems by providing an inexpensive, attractive holder for comestible products such as tacos or the like. The principal object of the present invention is to provide a portable unitary holder, of simple design, for supporting a comestible product such as a taco or the like comprising a generally U-shaped single piece body having a pair of flat generally rectangular, parallel walls contiguous with, projecting upwardly from, and perpendicular to a horizontal base which extends outwardly from the junctures of the walls and the base, whereby said parallel walls and base form a three sided receiving trough into which can be placed said comestible product so as to be vertically positioned and supported, whereby said comestible product is so maintained during both addition of fillings and consumption as to minimize loss of the fillings until the comestible product is completely consumed.

Another object of the instant invention is to provide a holder for supporting a comestible product, such as a taco or the like, comprising a generally U-shaped single piece body having two pairs of parallel members, contiguous with, projecting upwardly from, and perpendicular to a horizontal base which has extending outwardly in opposite directions, and in the same plane, two pairs of horizontal parallel members constituting a stabilizing base, whereby said parallel upwardly projecting members and said horizontal base form a receiving trough into which can be placed said comestible product so as to be vertically positioned and supported, whereby the two pairs of horizontal parallel members are perpendicular to the receiving trough, whereby said comestible product is so maintained during both addition of fillings and consumption as to minimize loss of the fillings until the comestible product is completely consumed.

Another object of the present invention is to provide inexpensive, easy to produce food holders of a novel design made of plastic material by means of injection molding as a single piece. Consequently no screws, bolts, glue or assembly are needed and the holders can be formed in attractive colors and with attractive molded designs so as to stimulate consumer interest.

The attractive molded design or topically applied design could be that of a known brand name or registered trademark.

A further object of this invention is to provide novel food holders which can withstand dishwasher temperatures and chemicals as well as comply with Food and Drug Administration regulations on food contact plastics. This facilitates reuse of the food holders of the instant invention.

A still further object of the instant invention is to provide novel food holders made of disposable materials such as low cost plastics, or cellulosic materials.

Another object of the present invention is to provide food holders of novel design made of ceramic material.

Another object of the present invention is to provide food holders of novel design made of materials selected for their ability to withstand the conditions found while cooking or warming foods within a microwave oven.

Yet another object of the instant invention is to provide a holder for supporting a comestible product such as a taco or the like comprising a single piece body formed by folding a planar material into a shape having a pair of flaps forming flat rectangular, parallel walls projecting upwardly from, and perpendicular to, a horizontal base which extends outwardly from the junctures of the walls and the base, whereby the parallel vertical walls are supported and maintained upright by generally triangularly shaped vertical flaps which are perpendicular to both the walls and the base, whereby said parallel walls and base form a three sided receiving trough into which can be placed said comestible product so as to be vertically positioned and supported, whereby said comestible product is so maintained during both addition of fillings and consumption as to minimize loss of the fillings until the comestible product is completely consumed.

These and other objects and advantages of the instant invention over the devices of the prior art will be apparent as the specification is considered with the accompanying drawings, following description and claims.

DETAILED DESCRIPTION

Figure 1:
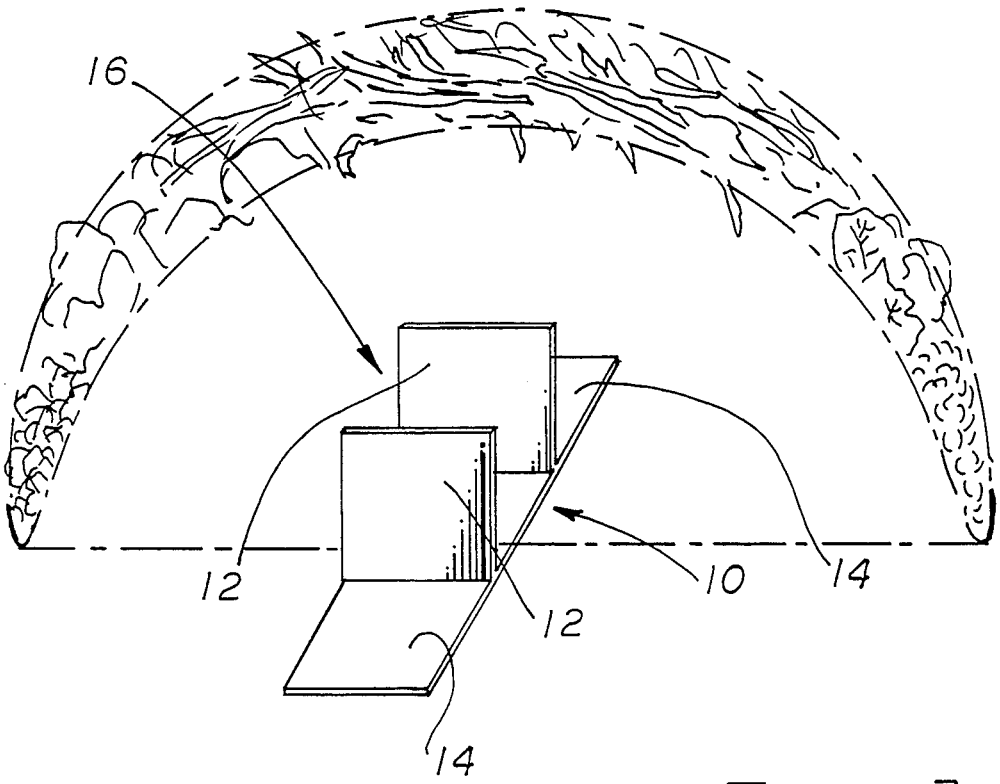
FIG. 1 is a perspective view of a freestanding holder according to the invention.

Referring to FIG. 1, numeral 10 identifies a portable generally "U"-shaped unitary holder for holding comestible products such as tacos or the like. The holder 10 is comprised of plastic material capable of being injection molded, extrusion formed, or fabricated of durable ceramic materials or disposable materials such as low cost plastic or cellulosic products. The holder 10 consists of walls 12 and base 14 whereby the walls 12 are situated parallel to each other, projecting upwardly from and perpendicular to the horizontal base 14, said base providing stability to the holder 10 by extending in both directions horizontally from the walls 12. The parallel and upwardly projecting walls 12 form between them a receiving trough 16 into which can be placed for holding upright the comestible product.

When a taco or similar food is vertically supported in the holder of the present invention with the open mouth side of the taco or similar food uppermost and the folded edge portion of the taco or similar food downwardmost, the taco or similar food fits between the parallel walls 12 and the folded edge portion of the food abuts the upper surface of the horizontal base 14 between said walls 12 so that the comestible product will be securely supported therein in an upright position. The taco or similar food may be easily withdrawn therefrom and reinserted thereinto until fully consumed, during which time the filling previously added tends to be retained therein due to the vertical position maintained. The filling is prevented from being dislodged therefrom, such as would be the case if a holder was not employed and the taco or similar food was temporarily laid in a horizontal position.

The vertical walls 12 and the horizontal base 14 provide planar surfaces upon which can be depicted logos, commercial trademarks, slogans, et cetera provided for customer appeal.

Figure 3:
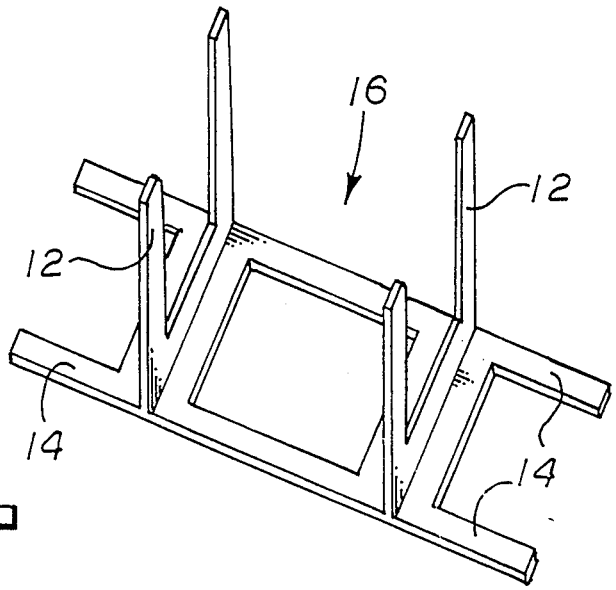
FIG. 3 is a perspective view of another embodiment of a freestanding holder according to the invention whereby the horizontal and planar sections of the device are finger-like projections.

Referring to FIG. 3, a lightweight device designed for manufacture by injection molding is shown.

Figure 4:
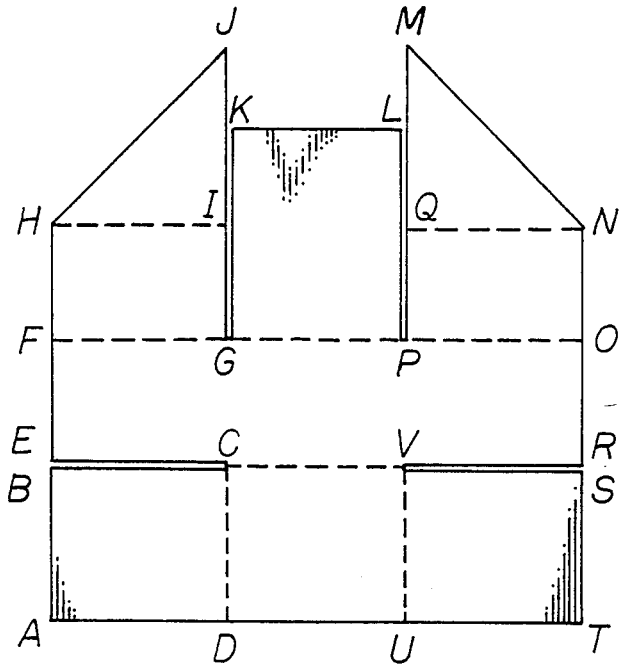
FIG. 4 is a two dimensional view of a piece of cellulosic material to be folded into the shape shown in FIG. 5.
Figure 5:
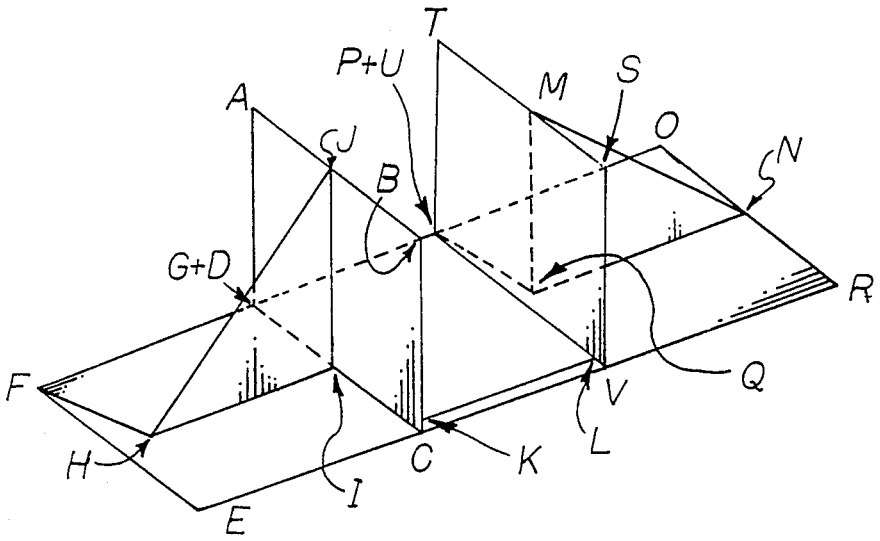
FIG. 5 is a perspective view of the piece of planar material from FIG. 4 upon being folded into the shape of the food holder according to the invention.

Referring to FIG. 4, the piece of planar material is to be folded into the food holder shown in FIG. 5 by a series of folds. To transform the piece of planar material depicted in FIG. 4 to the food holder device shown in FIG. 5, the flap defined by the points labeled A, B, S, and T is folded upwardly and over onto the section defined by the points labeled F, E, R, and O, respectively. The flaps defined by the points labeled A, B, C, D and T, S, V, U are then folded upwardly perpendicular to the food holder base defined by the points E, F, O, R. The flap defined by the points G, K, L, P is then folded upwardly and over onto the section D, C, V, U which has been folded over the section labeled GCVP. Next, the flaps F, H, J, G and O, N, M, P are folded upwardly and over onto the sections labeled E, F, G, C and V, P, O, R respectively. Finally, the triangle flaps defined by the points labeled H, I, J and N, Q, M are folded upwardly and perpendicularly to the base so as to wedge the edges defined by the lines IJ and QM against the vertical and parallel walls ABCD and STUV, respectively. The vertical and parallel walls defined by the points labeled ABCD and STUV, in conjunction with the portion of the base labeled CGPV, which has been overlaid by the flap labeled DCVU, form between them a receiving trough into which can be placed for holding upright the comestible product.

Holders for comestibles within the prior art exhibit drawbacks of complicated, expensive or inefficient designs. Such drawbacks have prevented the commercialization of disposable yet sturdy food holders particularly suited for tacos and similar foods. The present invention addresses this problem by utilizing inexpensive and easily processed materials such as cellulosic materials and plastics such as, for example, polystyrene. The consumer is provided by the present invention an attractive, sturdy, and inexpensive food holder which can be disposed of or easily cleaned for reuse.

A recent trend in cooking is the increased use of microwave ovens. However, certain materials such as metal and metal foils are not amenable to microwave cooking. Food holders of the present invention, formed from materials compatible with microwave oven conditions, such as ceramics and plastics, will provide the consumer with a desirable, useful and advantageous commodity for cooking or reheating various foods in microwave ovens without loss or spillage of condiments.

Reuse of the food holders of the instant invention may, at times, necessitate washing off food which may be spilled onto the holders. The instant invention includes food holders formed from plastics or other materials which are impervious to the temperatures and chemicals found in automatic dishwashers. These materials may be plastics, cellulosics, or ceramics similar to, or the same as, those selected for their ability to withstand conditions found in microwave ovens. The inventor hereby incorporates by reference, as materials suitable for the construction of the food holders of the instant invention, but does not wish to be limited to, those plastics, monomers, polymers, copolymers, etc., deemed safe for direct and indirect food contact by the Food and Drug Administration as published in Title 21 Code of Federal Regulations, Part 177, Subpart B, et seq.

The planar materials which are utilized in the fabrication of the food holder device depicted in FIG. 4 and FIG. 5 are relatively inexpensive, easy to die cut and/or coat and thus produce a convenient, novel and disposable food holder.

PREFERRED EMBODIMENT

A preferred embodiment of the present invention provides a unitary food holder device as shown in FIG. 1, wherein the food holder device is smaller than the food to be held. By being smaller than the food to be held, the holder can readily maintain the food in the upright position and still allow the consumer to easily grasp the end or ends of the food protruding from the device of the present invention.

Figure 2:
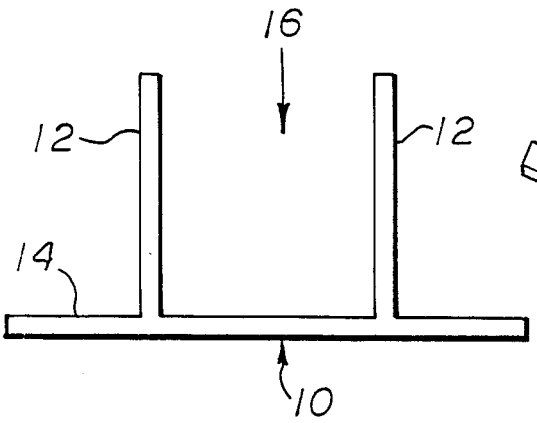
FIG. 2 is an end view of the holder of FIG. 1.

The device shown in FIG. 1 and FIG. 2 can be made by injection molding or preferrably by extrusion of a suitable plastic, followed by cutting the extruded product into the devices of FIG. 1 and FIG. 2. The skilled artisan will be able by this means to produce devices of varying desired widths.

Another preferred embodiment provides a unitary food holder device as shown in FIG. 3, wherein the food holder device presents a general shape similar to that of the device in FIG. 1 and FIG. 2 except that the interior of each planar surface is absent and only the edges or rims necessary for stability and structural integrity remain. This results in a device requiring substantially less material and one which is the preferred embodiment for manufacture by injection molding.

Yet another preferred embodiment provides a unitary food holder device prepared by folding a paper, cardboard, or other cellulosic material according to the pattern and shape shown in FIG. 4 and FIG. 5. The device shown in FIG. 4 and FIG. 5 is not limited to cellulosic material, however, but rather is limited only by the need to provide foldable, sturdy devices according to the invention. Any material readily folded into the shape depicted in FIG. 5 will perform in the instant invention, including, for example, foamed polystyrene.

While preferred embodiments of the designs of the instant invention have been described for elucidation, it will be appreciated that the present disclosure has been made only by way of example. Various changes and alterations in the details of construction may be made without departing from the spirit and scope of the present invention, which encompasses all such changes.

That which is claimed is:

1. A holder for supporting a comestible product such as a taco or the like comprising a single piece body formed by folding a planar material into a shape having a pair of flaps forming flat rectangular, parallel walls projecting upwardly from, and perpendicular to, a horizontal base which extends outwardly from the junctures of the walls and the base, whereby the parallel vertical walls are supported and maintained upright by generally triangularly shaped vertical flaps which are perpendicular to both the walls and the base, whereby said parallel walls and base form a three sided receiving trough into which can be placed said comestible product so as to be vertically positioned and supported, whereby said comestible product is so maintained during both addition of fillings and consumption as to minimize loss of the fillings until the comestible product is completely consumed.

2. A holder as claimed in claim 1 wherein the foldable planar material is cellulosic.

3. A holder as claimed in claim 1 wherein the foldable planar material is foamed polystyrene.

* * * * *